US005661254A

United States Patent [19]

Steuer et al.

[11] Patent Number: 5,661,254

[45] Date of Patent: Aug. 26, 1997

[54] SYSTEM FOR PROTECTING A TARGET FROM MISSILES

[75] Inventors: Raimar Steuer, Leinburg; Karl Rudolf, Schrobenhausen, both of Germany

[73] Assignee: Diehl GmbH & Co., Nürnberg, Germany

[21] Appl. No.: 786,499

[22] Filed: Jan. 21, 1997

Related U.S. Application Data

[63] Continuation of Ser. No. 500,412, Jul. 10, 1995, abandoned.

[30] Foreign Application Priority Data

Jul. 22, 1994 [DE] Germany ..... 44 26 014.8

[51] Int. Cl.[6] ..... F41F 3/04; F42B 12/32; F42B 15/00

[52] U.S. Cl. ..... 89/1.815; 89/1.701; 89/1.41; 89/41.07; 102/374; 102/491; 102/494; 102/496; 244/3.28

[58] Field of Search ..... 102/211, 265, 102/270, 374, 475, 491–497; 244/3.28, 3.29, 3.3; 89/1.11, 1.41, 1.7, 1.701, 1.814, 1.815, 1.816, 41.03, 41.07

[56] References Cited

U.S. PATENT DOCUMENTS

| | | | |
|---|---|---|---|
| 3,019,711 | 2/1962 | Bailey et al. | 89/41.07 |
| 3,102,451 | 9/1963 | Campbell | 89/41.07 |
| 3,727,221 | 4/1973 | Juliu et al. | 89/41.07 |
| 3,790,104 | 2/1974 | Jones | 244/3.27 |
| 3,946,640 | 3/1976 | Baumann | 89/41.07 |
| 3,974,771 | 8/1976 | Thomanek | 102/494 |
| 4,004,487 | 1/1977 | Eichweber | 89/1.815 |
| 4,080,900 | 3/1978 | Augenstein et al. | 102/495 |
| 4,302,666 | 11/1981 | Hawkins | 89/1.815 |
| 4,622,554 | 11/1986 | Gellekink et al. | 89/41.07 |
| 4,691,616 | 9/1987 | Larsson et al. | 89/41.07 |
| 4,768,440 | 9/1988 | Dineuville et al. | 102/495 |
| 4,848,239 | 7/1989 | Wilhelm | 102/492 |
| 5,003,885 | 4/1991 | Rudolf et al. | 102/494 |
| 5,036,748 | 8/1991 | Pendry | 89/41.07 |
| 5,147,973 | 9/1992 | Ziemba | 102/265 |
| 5,191,169 | 3/1993 | Hu | 102/491 |
| 5,229,540 | 7/1993 | Schabdach et al. | 89/41.03 |
| 5,261,629 | 11/1993 | Becker et al. | 102/496 |

FOREIGN PATENT DOCUMENTS

| | | | |
|---|---|---|---|
| 111192 | 6/1984 | European Pat. Off. | 89/41.07 |
| 41 28 313 | 3/1993 | Germany . | |
| 1108072 | 4/1968 | United Kingdom | 89/41.07 |
| 1150914 | 5/1969 | United Kingdom | 102/494 |
| 1220533 | 1/1971 | United Kingdom | 89/41.07 |
| 2216995 | 10/1989 | United Kingdom | 89/41.07 |

OTHER PUBLICATIONS

Article from "P.M." Magazine, vol. 17 (Oct. 1987).

*Primary Examiner*—Harld J. Tudor

*Attorney, Agent, or Firm*—Scully, Scott, Murphy & Presser

[57] ABSTRACT

Described is a system (10) for protecting a target such as an armoured vehicle, a bunker or the like from missiles. The protective system (10) has a launching container (12) with at least one launching tube (36) for an associated fragmentation projectile (38), mounted adjustably on a base portion (14). A sensor arrangement (26, 28) is provided for detecting the target to be combatted and aligning the launching container (12) with the target to be combatted. A control device (32) for a drive arrangement (24) is connected together with the sensor arrangement (26, 28) by way of a signal processing device (30). The drive arrangement (24) serves for aligning the launching container (12) with respect to the base portion (14). The/each fragmentation projectile has a special fragmentation filling (40) and a fuse device (44) for controlling the time of detonation.

7 Claims, 5 Drawing Sheets

SYSTEM FOR PROTECTING A TARGET FROM MISSILES

This application is a continuation of application Ser. No. 08/500,412, filed Jul. 10, 1995, now abandoned.

BACKGROUND OF THE INVENTION

1. Field of the Invention

The invention concerns a system for protecting a target, such as an armored vehicle, a bunker or the like from missiles.

The said target is for example an battle tank or an armoured personnel carrier, a shelter or dugout, a bunker or the like.

To provide protection for armoured vehicles from missiles, use is made for example of what is known as active armouring in which explosive charges are disposed on or between the armour plates of the armoured vehicle. The explosive charges are fired by the missile when it impinges on the armoured vehicle, whereby the impinging missile is deflected or destroyed. A tandem explosive head which at the explosive head tip has a hollow charge as well as a second explosive head was developed for use against active armouring of that kind. The hollow charge at the tip of the tandem explosive head is intended to fire the active armouring and the second explosive head is then intended to weld through the armouring at the correspondingly unprotected location thereof. That means however that such active armouring, as is described for example in the German journal 'P.M.' issue 17, 10/1987, represents only limited protection.

2. Discussion of the Prior Art

DE 41 28 313 A1 discloses a guided missile with a fragmentation-effect active portion which can be initiated in dependence on proximity, for providing protection in particular against a tactical warhead which enters along a steep re-entry path at high relative speed. That guided missile is designed for active optimisation at the target without a high level of additional expenditure on sensor means for initiation of the active defence portion. For that purpose the function of a distance fuse is taken over by a search head of the preadjusted missile itself, insofar as in addition to determining the target angle for actuation of control means of the guided missile and for orientation of the fragmentation-effect active angle in the search head the relative approach speed as between the guided missile and the warhead to be combatted as well as continuously the reducing distance between the two are measured. Although that known guided missile is suitable for at least greatly reducing or eliminating the effect of the threat, that is to say the action of a tactical warhead, outside a lethal distance from the target, its structural or apparatus expenditure is however still correspondingly high.

The invention is based on the problem of providing a protective system of the kind set forth in the opening part of this specification, which, while being of a comparatively simple configuration, affords a good option of protection against the large number of existing means of attack.

SUMMARY OF THE INVENTION

The advantages which are achieved with the system according to the invention for protecting a target such as an armoured vehicle, a bunker or the like from missiles are in particular that it is of a comparatively simple configuration and represents a lightweight system with a high protective effect, affording what is known as all-around protection for a target. A further advantage of the protective system according to the invention is achieved by virtue of the fact that it does not use any cost-intensive active sensor means, but only a passive sensor means is required. A further major advantage of the protective system according to the invention lies in the fact that it can be subsequently fitted, so that the protective system according to the invention can for example be very easily mounted on existing armoured vehicles, without the protective system then making itself particularly noticeable in terms of the overall dimensions of the armoured vehicle. The armoured vehicles may also be light armoured vehicles. In accordance with the invention a defence against hostile means of attack is already possible at a distance of for example 15 to 30 meters so that disintegration for example of hollow charge devices or other active carriers is advantageously guaranteed.

BRIEF DESCRIPTION OF THE DRAWINGS

Further details, features and advantages will be apparent from the following description of an embodiment, illustrated in the drawing, of the system according to the invention for protecting a target from missiles. In the drawing.

DETAILED DESCRIPTION OF PREFERRED EMBODIMENTS

Figure 1:
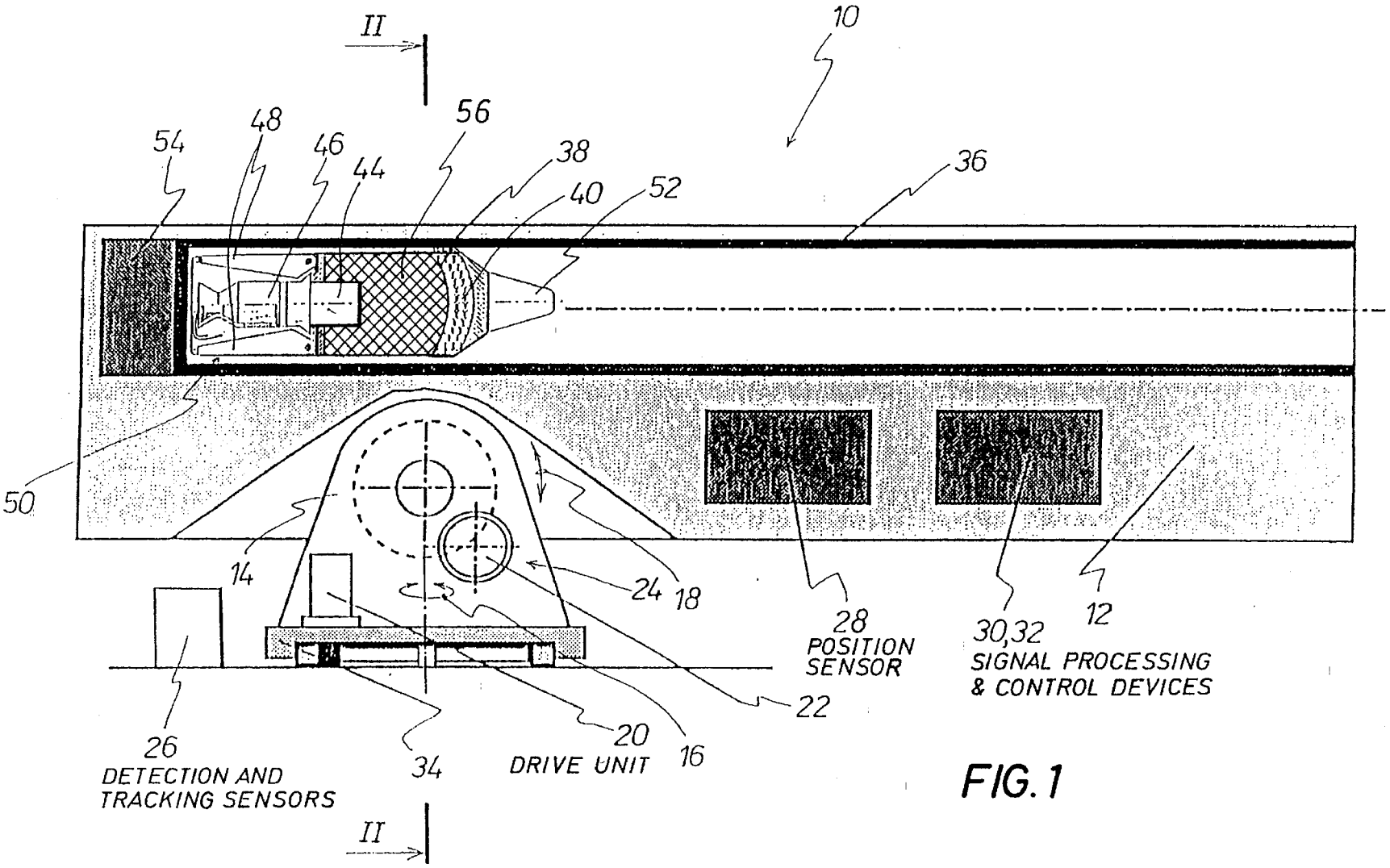
FIG. 1 is a view in longitudinal section through the protective system.

FIG. 1 is a view in longitudinal section of essential parts of the system 10 for protecting a target from missiles comprising a launching container 12 which is disposed on a base portion 14 adjustably in respect of azimuth and elevation. Adjustability in respect of azimuth is indicated by the arcuate double-headed arrow 16 and adjustment in respect of elevation is indicated by the arcuate arrow 18. Adjustment in respect of azimuth is effected by means of a drive 20 and adjustment in respect of elevation is effected by means of a drive 22. The drives 20 and 22 therefore form a drive arrangement 24 which is provided for aligning the launching container 12 relative to the base portion 14, with a missile to be combatted.

For the purposes of detecting a target to be combatted, that is to say a missile to be combatted, the assembly has a detection sensor 26 which can possible also be suitable for target tracking, that is to say it can be in the form of a so-called track sensor. Desirably the detection or track sensor 26 is in the form of a high-resolution pulse doppler radar sensor.

The launching container 12 is desirably provided with a position sensor 28 which, like the detection or track sensor 26, is only diagrammatically indicated in FIG. 1 in the form of a block. The launching container 12 is also provided with a signal processing device 30 and a control device 32 for the drive arrangement 24, in which respect the signal processing device 30 and the control device 32 are also only diagrammatically indicated in the form of blocks.

The detection or track sensor 26 which is arranged stationarily at the target and the position sensor 28 provided on the launching container 12 jointly form a sensor arrangement which are connected together with the control device 32 by way of the signal processing device 30. The control device 32 is connected together with the drive arrangement 24, that is to say the two drives 20 and 22.

The base portion 14 for the launching container 12 is desirably in the form of a carriage 13. As can be clearly seen from FIG. 2, the launching container 12 has launching tubes 36 for respective fragmentation grenades or projectiles 38, the launching tubes 36 being disposed at spacings from each other and in mutually parallel relationship. Each launching tube 36 is provided at its end towards the ground with a recoil damping member 54. A fragmentation projectile 38 is shown in section in FIG. 3. The fragmentation grenade 38 has a special fragmentation filling 40, an explosive charge 56, a fuse device 44 and a pulse engine 46 of which part is shown in section on one half thereof. The fragmentation filling 40 maybe arranged so that upon detonation, there is produced a fragmentation cone subtending an aperture angle in the order of magnitude of about 10–20 degrees. Each fragmentation projectile is also provided with rudder vanes which can be pivoted out of an associated housing portion 50 of the fragmentation projectile 38. FIG. 3 shows the upper rudder vane 48 in the outwardly pivoted flight position while the lower rudder vane 48 is shown in the inwardly pivoted rest position. In comparison FIG. 1 shows all rudder vanes 48 in the inwardly pivoted rest position.

Reference numeral 52 in FIG. 3 shows a proximity or time fuse which can also be omitted in the fragmentation projectile 38 because the moment of firing thereof can be established by the fuse device 44. It is also advantageous with this fragmentation charge configuration that a human gunner in the near vicinity must behave very carefully.

Figure 2:
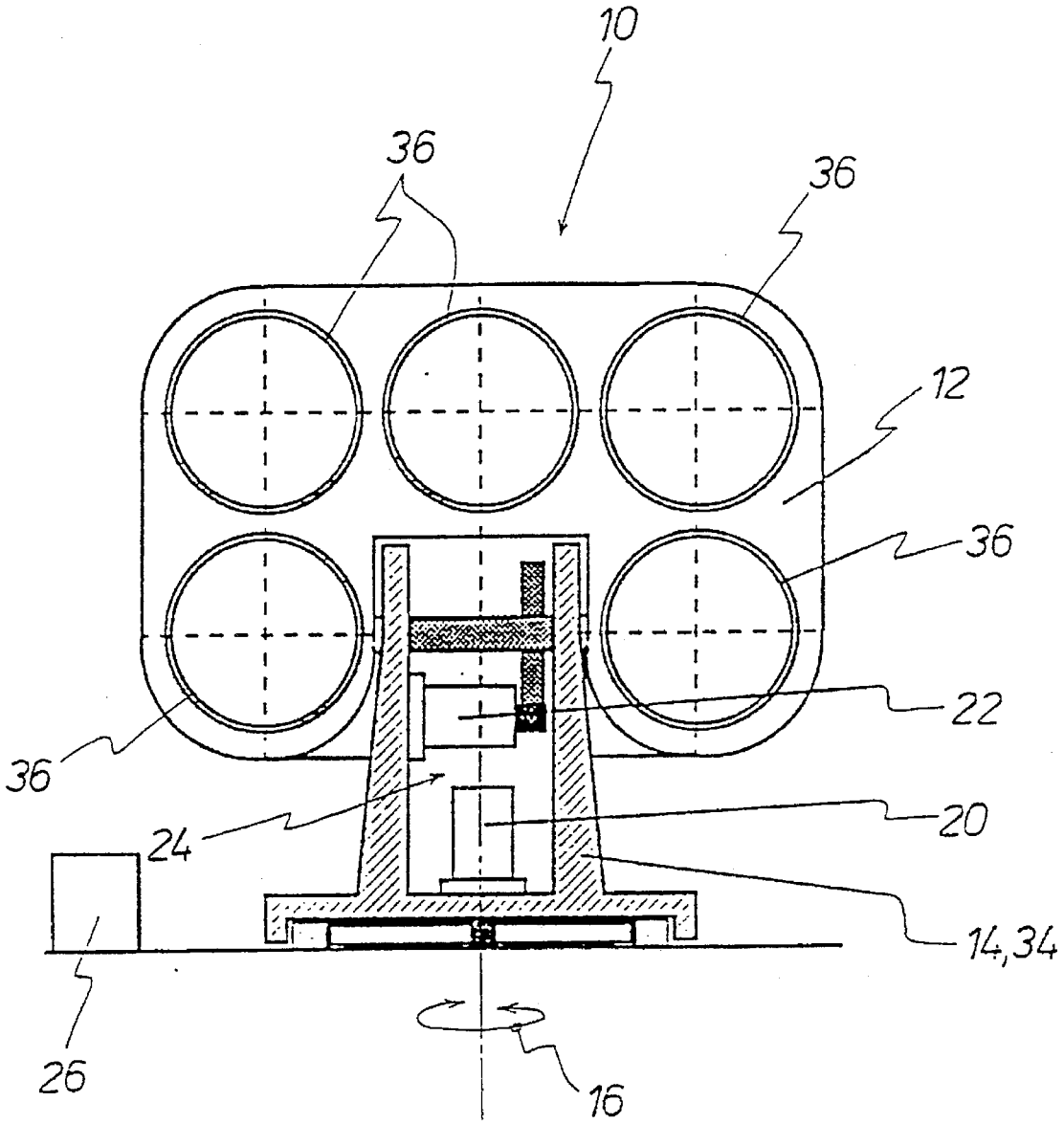
FIG. 2 is a view in cross-section through the protective system taken along line II—II in FIG. 1, without however showing the fragmentation projectiles disposed in the launching tubes.
Figure 3:
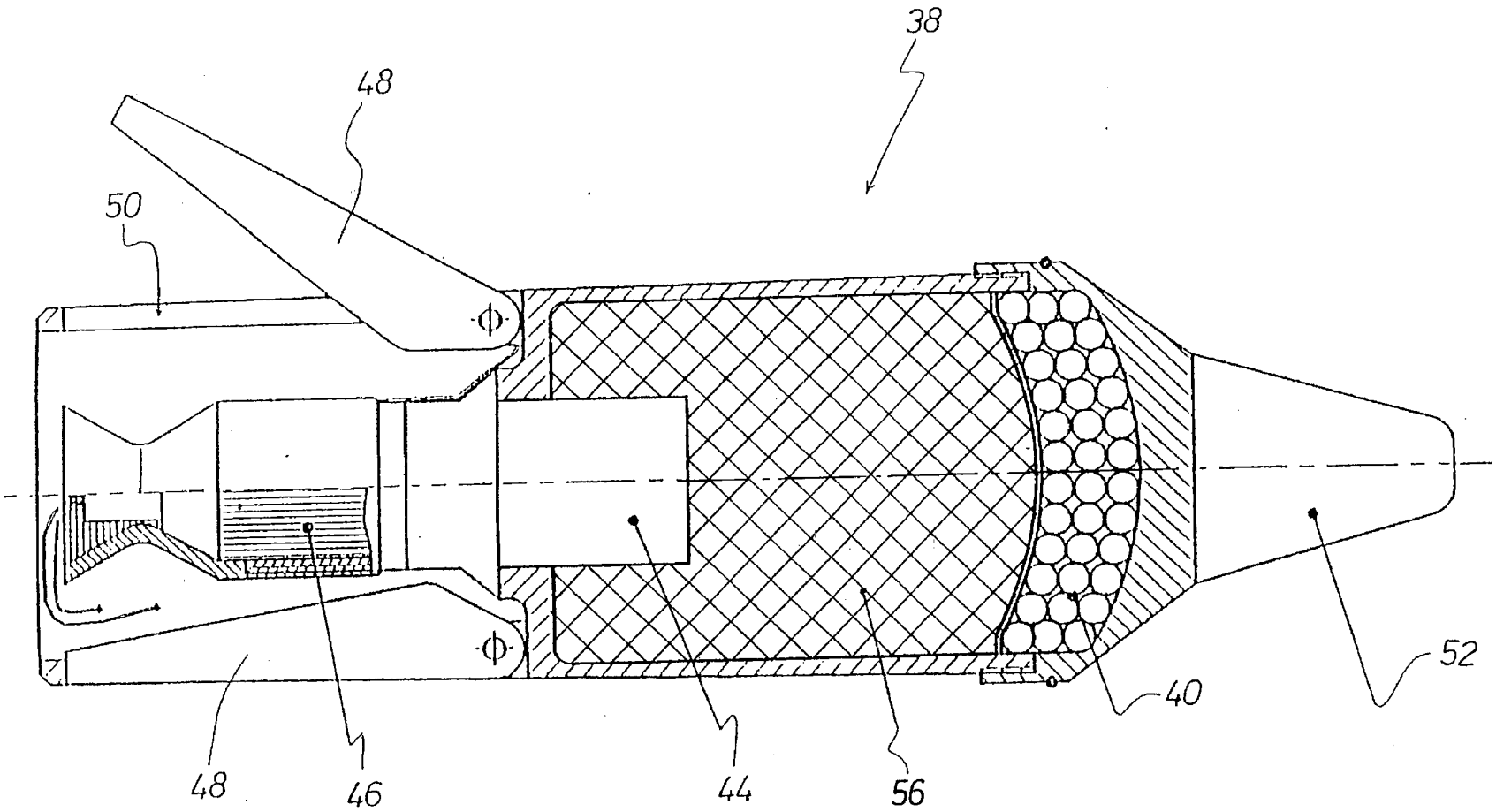
FIG. 3 is a view in longitudinal section through a fragmentation projectile of that kind, wherein a part of the impulse engine is shown in section on one half side thereof and one of the rudder vanes is shown in the outwardly pivoted flight position.

The same details are each identified by the same references in FIGS. 1 to 3 so that there is no need to enter into a detailed description of all features in connection with all those Figures.

Figure 4:
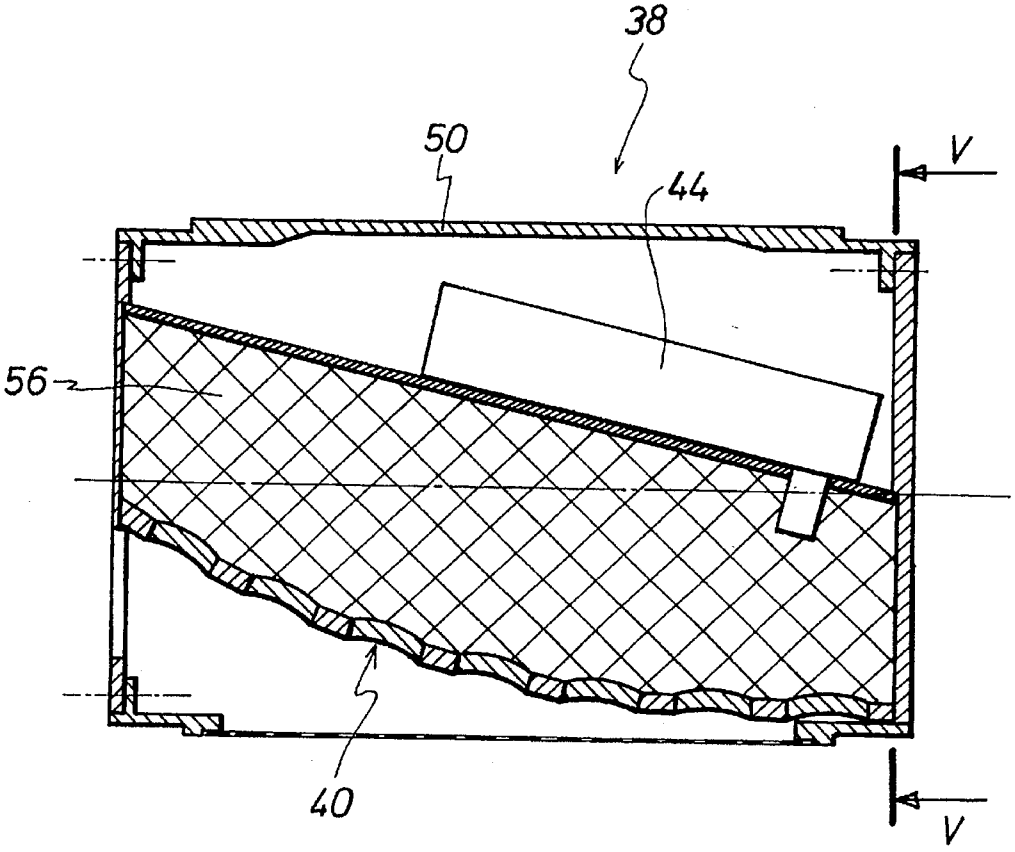
FIG. 4 shows a part of a further embodiment of a fragmentation projectile.
Figure 5:
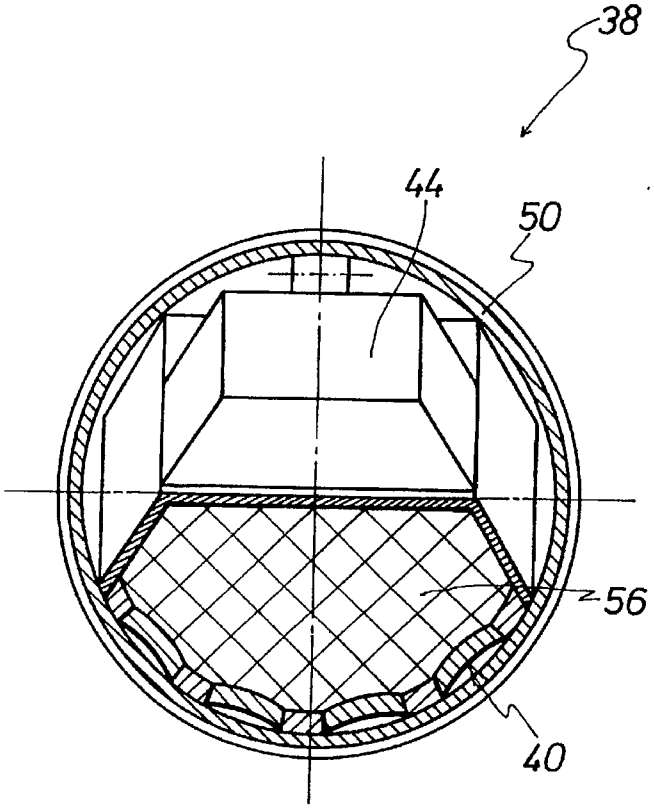
FIG. 5 is a view in section taken along section line V—V in FIG. 4.
Figure 6:
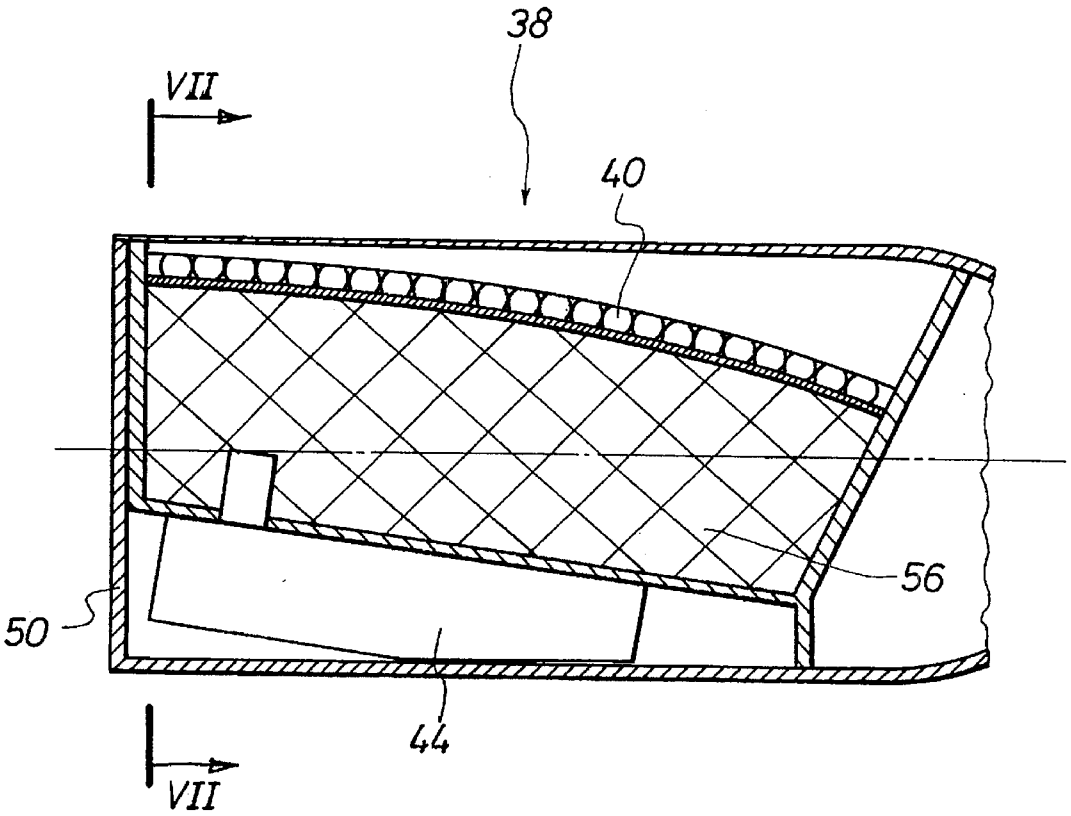
FIG. 6 is a view similar to FIG. 4 of another embodiment of a fragmentation projectile.
Figure 7:
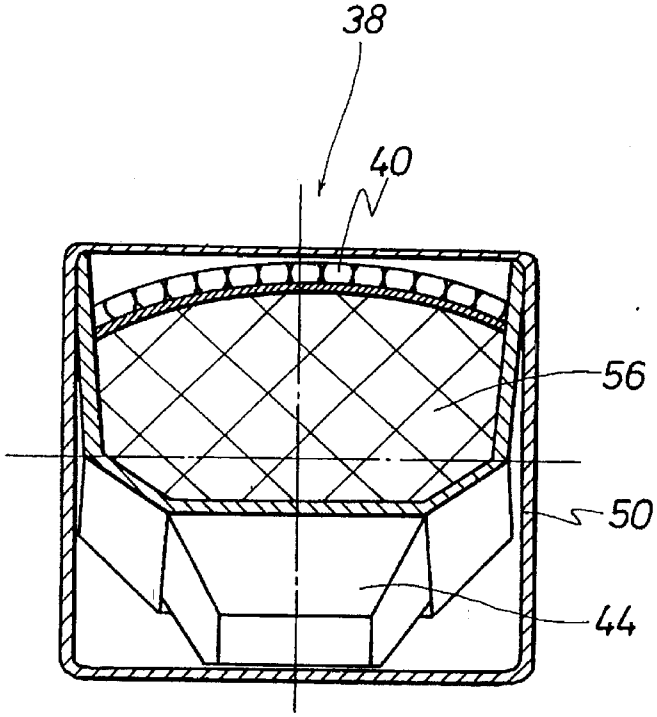
FIG. 7 is a view in section taken along section line VII—VII in FIG. 6.

FIGS. 4 and 5 show a fragmentation active portion of the projectile 38 according to the invention, with which it is possible to combat a hostile object with a directional effect, that is to say for example at the side from below. In this arrangement an explosive body 56 with a fuse device 44 is disposed in a housing portion 50. The above-mentioned directional effect is afforded by the specific configuration of the explosive body 56 and fragmentation portion 40. With such a fragmentation active portion, it is possible to produce high-speed fragments which may involve a speed of the order of magnitude of 2000 m/sec and more. In that way irregular triggering of a hostile object to be combatted is more probable than a triggering action by way of the hostile sensor assembly. With increasing approachability of the projectile 38 to a hostile object to be combatted the fragmentation active portion of the configuration shown in FIGS. 4 and 5 can increasingly assume a parallelepipedic or cubic shape, as is shown in FIGS. 6 and 7. Such an at least approximately rectangular cross-section in respect of the active portion and therewith the projectile 38 makes it advantageously possible for the packaging density of the associated launching container to be substantially increased. At the same time that advantageously results in a reduction in the moments of inertia of a loaded launcher. This also has an advantageous effect on the overall structure since, as a result of the reduced moments of inertia, the drive for the aiming arrangement can be of lower power without thereby having an adverse effect on the operability of the system.

A hostile missile is preferably combatted from below with a projectile as shown in FIGS. 6 and 7 because in that way the effects of detonation of the defence projectile are locally greatly delimited.

The same details are identified by the same references in FIGS. 4 to 7 as in FIGS. 1 to 3 so that there is no need for all those features to be described in detail once again in connection with FIGS. 4 to 7.

We claim:

1. A system for protecting a target from at least one oncoming guided airborne missile; said system comprising a fragmentation projectile launching container; a base portion having said launching container mounted thereon so as to be adjustable in azimuth and elevation; a plurality of launching tubes each containing a fragmentation projectile, arranged in said launching container; a sensor arrangement for detecting the airborne missile against which the target is to be protected; a drive arrangement for said launching container operatively connected with the sensor arrangement; signal processing means and control means located on the launching container for adjusting the launching container relative to the base portion and for orienting said launching tubes with the fragmentation projectiles positioned therein in a direction towards said oncoming airborne missile and launching said fragmentation projectiles at a predetermined distance in close proximity of said airborne missile from the target; each of said fragmentation projectiles being provided with an active charge of approximately rectangular cross-section transversely of a longitudinal axis of said fragmentation projectile constituting a fragmentation filling which fragments laterally and a fuze for selectively controlling the detonation of said projectile in dependence upon time and close proximity to the target whereby fragments from said projectile ignite or destroy a warhead of said airborne body at said predetermined distance from said target, each of said fragmentation projectiles having an impulse engine which launches the projectile operatively associated therewith from its launch tube and extendable control surfaces on each of said fragmentation projectiles for stabilization during flight.

2. A system according to claim 1, wherein said fragmentation filling of said at least one fragmentation projectile produces a fragmentation cone having a aperture angle in the order of magnitude of about 10 to 20 degrees upon detonation.

3. A system according to claim 1, wherein said launching container includes a plurality of said launching tubes which are spaced form each other and extend in parallel with each other for respectively said fragmentation projectile.

4. A system according to claim 1, wherein said base portion comprises a carriage having said drive arrangement located thereon for orientation the launching container against the oncoming airborne body missile.

5. A system according to claim 1, wherein said sensor arrangement comprises a detection sensor for airborne missile detection and a tracking sensor for tracking of the airborne missile.

6. A system according to claim 1, wherein the sensor arrangement comprises a high-resolution pulse-doppler radar sensor.

7. A system according to claim 1, wherein said sensor arrangement includes a positional sensor located on said launching container.

* * * * *

UNITED STATES PATENT AND TRADEMARK OFFICE

CERTIFICATE OF CORRECTION

PATENT NO. : 5,661,254
DATED : August 26, 1997
INVENTOR(S) : Raimer Steuer, et al.

It is certified that error appears in the above-indentified patent and that said Letters Patent is hereby corrected as shown below:

Column 4, line 48, Claim 3: "form" should read --from--

Column 4, line 49, Claim 3: after "respectively" insert --containing one--

Column 4, line 53, Claim 4: "orientation" should read --orientating--

Signed and Sealed this

Eleventh Day of August 1998

Bruce Lehman

*Attest:*

BRUCE LEHMAN

*Attesting Officer*

*Commissioner of Patents and Trademarks*